US005358016A

United States Patent [19]

Emmerich

[11] Patent Number: 5,358,016

[45] Date of Patent: Oct. 25, 1994

[54] APPARATUS FOR MAKING CABLE HARNESSES

[75] Inventor: Herbert Emmerich, Waiblingen, Fed. Rep. of Germany

[73] Assignee: Fraunhofner-Gesellschaft zur Forderung der Angewandten, Fed. Rep. of Germany

[21] Appl. No.: 917,147

[22] PCT Filed: Feb. 7, 1991

[86] PCT No.: PCT/DE91/00100

§ 371 Date: Sep. 10, 1992

§ 102(e) Date: Sep. 10, 1992

[87] PCT Pub. No.: WO91/12708

PCT Pub. Date: Aug. 22, 1991

[30] Foreign Application Priority Data

Feb. 9, 1990 [DE] Fed. Rep. of Germany ..... 4003995

[51] Int. Cl.[5] ..... B21F 27/12

[52] U.S. Cl. ..... 140/92.1; 29/755

[58] Field of Search ..... 140/92.1; 29/755

[56] References Cited

U.S. PATENT DOCUMENTS

| | | | |
|---|---|---|---|
| 3,346,020 | 10/1967 | Geisinger | 140/92.1 |
| 4,442,872 | 4/1984 | Gibbons | 140/92.1 |
| 4,724,612 | 2/1988 | Pearson | 29/755 |

FOREIGN PATENT DOCUMENTS

| | | |
|---|---|---|
| 1183966 | 12/1964 | Fed. Rep. of Germany . |
| 1640570 | 12/1970 | Fed. Rep. of Germany . |
| 2126860 | 5/1972 | Fed. Rep. of Germany . |
| 109478 | 2/1974 | Fed. Rep. of Germany . |
| 3822136 | 1/1989 | Fed. Rep. of Germany . |
| 3826991 | 11/1989 | Fed. Rep. of Germany . |
| 3820637 | 12/1989 | Fed. Rep. of Germany . |
| 3827009 | 2/1990 | Fed. Rep. of Germany . |
| 3827010 | 2/1990 | Fed. Rep. of Germany . |

OTHER PUBLICATIONS

Thomas & Betts Publication, pp. 26–27, Jun., 1975.

*Primary Examiner*—Lowell A. Larson
*Attorney, Agent, or Firm*—Evenson, McKeown, Edwards & Lenahan

[57] ABSTRACT

Disclosed is an apparatus for making cable harnesses having a formboard onto which routing means, such as connector housings cavities, routing aids, etc., can be attached which hold, respectively, guide the wires while the cable harness is being assembled.

The present invention is distinguished in that an ejection plate which can be moved away from the formboard in order to eject said cable harness is disposed on the front side of said formboard, and that the routing means can be attached onto the formboard through holes in the ejection plate.

7 Claims, 1 Drawing Sheet

APPARATUS FOR MAKING CABLE HARNESSES

DESCRIPTION

Technical Field

The present invention relates to an apparatus for making cable harnesses having a formboard onto which routing means can be attached, such as connector housing cavities. routing aids, etc., which, respectively guide, the wires while the cable harness is being assembled.

BACKGROUND OF THE INVENTION

There are many different known attempts at manufacturing cable harnesses automatically, which have hitherto been fabricated predominantly by hand.

In the presently promising pilot automatic cable harness fabrication systems, formboards of the type set forth in the characterizing part of claim 1 hereto and one or more industrial robots are utilized which route the wires between the individual connector housing cavities on the formboard with routing and/or contacting tools of various design. The "shape" of the cable harness is determined by the so-called routing aids which may be designed as guiding and/or bundling means.

The hitherto known proposals for the automatic production of cable harnesses are concerned with routing the wires, fastening (contacting) the wires in the connector housing cavities, respectively sheathing the individual subbranches of the cable harness. In this case, following assemblage, the cable harnesses are removed from the formboard by an industrial robot or a handling device. This is a relatively time consuming procedure as the industrial robot does not only have to change suited tools but also has to remove the individual subbranches of the cable harness singly from the routing aid.

In the older application P 38 27 010.7, therefore, to which the present application is a patent of addition, a solution is described permitting simple automatic removal of the assembled cable harness from the formboard together with the routing means, such as connector housing cavities, routing aids, etc., which, respectively guide, the wires while the cable harness is being assembled.

The solution described in the present application is particularly advantageous if the cable harnesses are fabricated as "individual pieces" or if the routing aids are to remain on the cable harnesses as assembly aids as in each instance the routing means will be removed together with the cable harness. This, however, is no problem in the individual fabrication of cable harnesses as the formboard has to be "loaded" anew anyway prior to the fabrication of the individual cable harnesses.

SUMMARY OF THE INVENTION

An object of the present invention is to improve an apparatus for making cable harnesses having a formboard onto which routing means, such as connector housing cavities, routing aids, etc. can be mounted, in such a manner that the finished assembled cable harness can be automatically removed without also having to remove the routing means at the same time.

A solution to this object in accordance with the present invention with its further developments is set forth in the claims hereto.

The present invention is based on the fundamental concept that removal of a finished assembled cable harness from a formboard with an industrial robot is very time consuming: by way of illustration the industrial robot would have to "approach" every single connector housing cavity on the each subbranch of the cable harness, remove the connector housing from the cavity, then grasp the cable harness at a central point and remove it from the formboard: then, in particular, if subsequently a different type cable harness is to be fabricated, the industrial robot would have to remove all the routing means, such as connector housing cavities, routing aids, etc.

An inventive element is therefore that a (central) ejection unit is provided which, in order to remove the cable harness following that part of the fabrication process that is performed on the formboard, releases the connection between the routing means, such as by way of illustration connector housing cavities, routing aids, etc., and the cable harness, respectively the connector housings attached thereon in such a manner that they are slipped off the formboard.

For this purpose, an ejection plate which can be moved in order to eject the cable harness from the formboard is disposed on the front side of the formboard.

The ejection unit provided in accordance with the present invention permits very easy removal of the cable harnesses from the formboard and, by way of illustration, to carry them on a conveyor belt, respectively a transport means, to the next station, by way of illustration final assemblage, a control station or the like.

Furthermore, the "central ejection unit" provided in accordance to the present invention permits slipping cable harnesses of different sizes and configurations very quickly and simply off the formboard. This procedure takes substantially less time than, by way of illustration, having an industrial robot remove the cable harness.

Further developments of the present invention are set forth in the subclaims hereto.

The routing means can be connected to the formboard in many different ways, with coupling connections, in particular, being preferred which can be released by a central ejection unit. Coupling connections of this type can be realized, by way of illustration, by means of magnetic or adhesive forces, etc.

According to claim 2, the routing means can be locked into openings in the formboard by means of clips through holes in the ejection plate. Furthermore, a slip-off plate which can be pressed between the clips and the formboard in order to release the lock connection is disposed on the rear side of the formboard.

This slip-off plate, respectively slip-off unit, may, of course, be disposed in the routing station so that the routing means can be removed immediately after routing and contacting the individual wires without the formboard "changing place". However, the ejection unit, i.e. the slip-off plate for the routing means, may also be disposed in an ejection station into which the formboard can be conveyed from the routing station by way of a transport means, by way of illustration a roller conveyor or the like.

The further development according to claim 2 is advantageous, in particular, if the cable harnesses are to be fabricated fully automatically in small lots and random cable configurations.

As in this development not only the cable harness, but in addition also the routing means can be removed in a single step, the invented formboard can be adapted fully automatically specifically for the variant by an industrial robot:

Following the assemblage of a cable harness lot not only the "last cable harness of this lot" is removed fully automatically from the formboard, but also the routing means. This occurs simultaneously for all the fastening elements, respectively routing means. In the event of an impending variant change the routing aids positioned by the industrial robot can thus also be ejected from the formboard automatically and practically simultaneously with the ejection of the cable harness so that the time consumed for the change procedure is substantially reduced.

In the embodiment according to claim 3, the routing means are provided with an extension which engages in a formfitting manner into the openings in the formboard yielding an especially firm fit.

A further development is described in claim 4 in which piston/cylinder units are provided which are supported by the formboard and which move the ejection plate and, if need be, the slip-off plate in relation to the formboard. This embodiment simplifies construction even more.

In the further development described in claim 5, connector housing cavities from which the connector housings can be ejected with separate piston/cylinder units are provided on at least one side of the formboard. This solution has the advantage, in particular, if only routing, respectively bundling aids are disposed on the formboard, that the mechanical stress occurring due to the ejection of the connector housing from the respective cavity does not have to be absorbed by the slip-off plate for the cable harness.

BRIEF DESCRIPTION OF THE DRAWING

The present invention is made more apparent in the following section using preferred embodiments with reference to the accompanying drawing by way of illustration without the intention of limiting the overall inventive idea. It is expressly pointed out that this drawing is to be referred to for the disclosure of all the invented details not made more apparent in the text hereto.

DESCRIPTION OF THE PREFERRED EMBODIMENTS

Figure 1A:
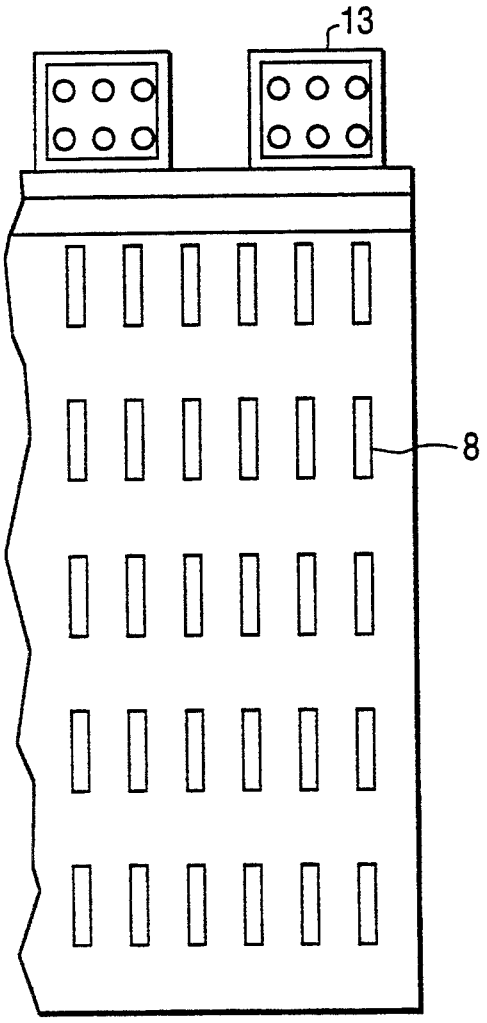
FIG. 1*a* shows a top view of an invented formboard.
Figure 1B:
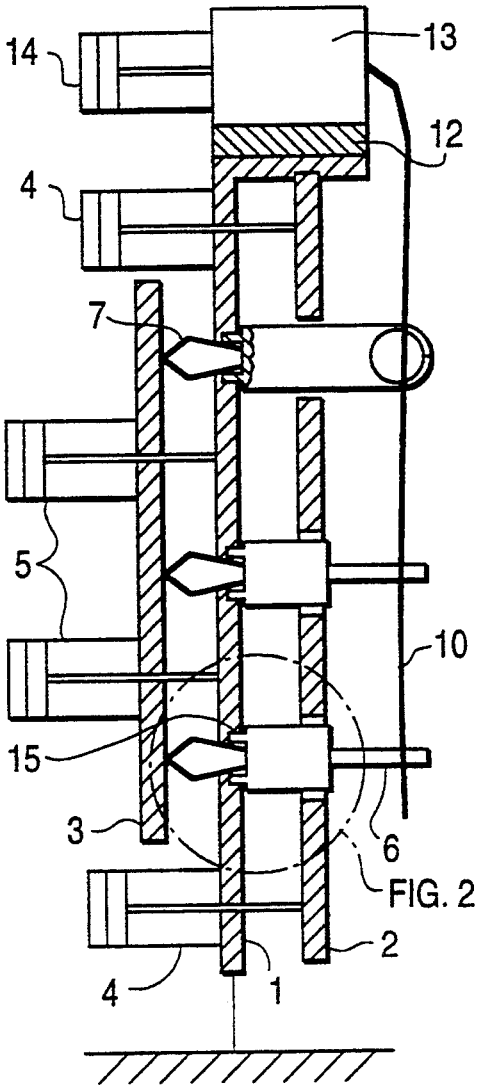
FIG. 1*b* shows a section through a formboard.

As FIG. 1 shows, the formboard (1) has numerous holes (8) with a specific grid into which the routing means, such as connector housing cavities or (preferably only) routing aids, respectively bundling aids (6) can be inserted by means of clips (7).

Figure 2:
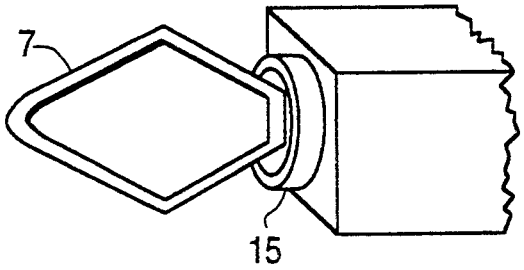
FIG. 2 shows an exploded view of a detail of FIG. 1*b*.

FIG. 2 shows that the routing means (6), that is by way of illustration the connector housing cavities and the routing aids are not only provided with clips (7) which are inserted through the holes (8) of the formboard. In addition a surrounding collar (15) is provided establishing a firm locking connection between the formboard (1) and the routing means in the "transverse direction".

Disposed before the formboard (1) is a slip-off plate (2) for the assembled cable harness. This slip-off plate (2) also has holes corresponding to holes (8) through which the routing means can be attached to the formboard (1). The ejection movement of the slip-off plate (2) away from the formboard (1) by means of which a finished assembled cable harness is released from the routing means (6) is realized with the aid of pneumatic cylinders (4).

Provided behind the formboard (1) is an ejection plate (3) for the routing means. This ejection plate (3) can press against clips (7) and in this manner "unlock" the routing means (6). The ejection movement of the ejection plate (3) toward the formboard (1) is carried out with the aid of the pneumatic cylinders (5).

Furthermore, in the depicted preferred embodiment connector housing cavity panels (12) are provided for the connector housings (13) on one side of the formboard, whereas on the actual formboard are only routing, respectively bundling, aids (6). The connector housings (13) can be ejected from the cavity panels (12) by means of the pneumatic cylinder (14). In this way the connector housings do not have to be ejected by the movement of the slip-off plate (2) thus facilitating the mechanical movement.

The manner of operation of the invented formboard is described in the following:

A not illustrated industrial robot mounts routing means (6) onto the formboard (1) in accordance with the geometric configuration of the cable harness with an appropriate tool. This is done in that the industrial robot inserts the clips (7) on the routing means (6) into the attachment slots (8). By means of the clips (7) they automatically lock into the base plate. The surrounding collar (15) at the routing means (6) ensures that the routing means (6) can absorb transverse forces generated by the routing procedure. Furthermore, the industrial robot mounts the required connector housings (13) onto the cavity panels (12).

Following assemblage of the cable harness (10), it can be ejected automatically out of the routing and bundling means (6), which can also serve as holding elements, by means of a movement of the slip-off plate (2) away from the formboard (1). This is realized by the cable harness (10) being pressed out of the holding ring of the routing aids without fail by means of a relative movement of the slip-off plate (2) and the routing aid (6). Simultaneously the connector housings (13) are ejected from the cavity panels (12) by means of a movement of the pneumatic cylinders (14).

If a cable harness with a new geometric configuration is to be assembled, the routing aids can also be removed from the formboard (1) with the aid of the slip-off plate (3).

The ejected routing aids can, e.g., be transported to a holding station, from where an industrial robot can take them up once more, by means of a not depicted material flow system.

In the present invention has been described herein using a preferred embodiment without the intention of limiting the scope or spirit of the overall inventive idea, within which there are, of course, many different modifications possible:

Thus the preferred coupling connection between the routing means and the formboard is by no means limited to clips. Of course, other connections, by way of illustration connections based on magnetic forces, etc. can also be employed.

What is claimed is:

1. An apparatus for making cable harnesses, comprising:

a formboard onto which routing devices such as connector housing cavities, routing aids and the like can be attached for holding and guiding wires during assembly thereof into a cable harness, and a slip-off plate disposed between the formboard and a cable harness during assembly thereof, said slipoff plate including holes for accommodating attachment of said routing devices to the formboard, and a slip-off plate moving apparatus for moving the slip-off plate away from the formboard to thereby eject an assembled cable harness from the cable routing devices, wherein at least one side of said formboard has connector housing cavities from which the connector housing can be ejected;.

and further comprising piston/cylinder units separate from the slip-off plate moving apparatus and operatively coupled to the connector housing to eject the connector housing from the connector housing cavities.

2. Apparatus according to claim 1, further comprising an ejection plate disposed at a side of the form-board opposite the form-board side facing the slip-off plate, wherein said routing devices are selectively lockable in openings in said form-board by clips which are passed through said holes in the slip-off plate, and wherein said ejection plate is movably supported to be selectively pressed against the clips to release the locking connection of the clips to the formboard.

3. An apparatus according to claim 2, wherein said routing means have an extension which engages in a form-fitting manner into the openings in said formboard.

4. An apparatus according to claim 3, wherein piston/cylinder units are provided which are supported by said formboard and move at least one of said slip-off plate and said ejection plate relative to said formboard.

5. An apparatus according to claim 2, wherein piston/cylinder units are provided which are supported by said formboard and move at least one of said slip-off plate and said ejection plate relative to said formboard.

6. An apparatus according to claim 2, wherein piston/cylinder units are provided which are supported by said formboard and move at least one of said slip-off plate and said ejection plate relative to said formboard.

7. An apparatus according to claim 1, wherein only routing, respectively, bundling aids are provided on said formboard.

* * * * *